US006569492B2

(12) United States Patent
Fernihough et al.

(10) Patent No.: US 6,569,492 B2
(45) Date of Patent: May 27, 2003

(54) PROCESS FOR REPAIRING A COATED COMPONENT

(75) Inventors: John Fernihough, Ennetbaden (CH); Abdus S. Khan, Ennetbaden (CH); Maxim Konter, Klingnau (CH); Markus Oehl, Waldshut-Tiengen (DE); Hans-Joachim Dorn, Ennetbaden (CH)

(73) Assignee: Alstom Ltd, Baden (CH)

( * ) Notice: Subject to any disclaimer, the term of this patent is extended or adjusted under 35 U.S.C. 154(b) by 0 days.

(21) Appl. No.: 09/870,502

(22) Filed: Jun. 1, 2001

(65) Prior Publication Data

US 2001/0053410 A1 Dec. 20, 2001

(30) Foreign Application Priority Data

Jun. 5, 2000 (EP) ..... 00112068

(51) Int. Cl.[7] ..... B05D 7/14

(52) U.S. Cl. ..... 427/142; 427/140; 427/156; 427/248.1; 427/250; 427/252; 427/307; 427/328; 427/404; 427/405; 427/419.2; 427/258; 427/282; 427/287; 29/889.1

(58) Field of Search ..... 427/140, 142, 427/156, 248.1, 250, 252, 307, 328, 404, 405, 419.2, 258, 282, 287; 29/889.1

(56) References Cited

U.S. PATENT DOCUMENTS

| | | | | |
|---|---|---|---|---|
| 3,528,861 A | | 9/1970 | Elam et al. | |
| 4,004,047 A | | 1/1977 | Grisik | |
| 4,152,223 A | | 5/1979 | Wallace et al. | |
| 4,585,481 A | | 4/1986 | Gupta et al. | |
| 5,728,227 A | | 3/1998 | Reverman | |
| 5,794,338 A | | 8/1998 | Bowden, Jr. et al. | |
| 5,972,424 A | | 10/1999 | Draghi et al. | |
| 6,042,880 A | * | 3/2000 | Rigney et al. | 29/889.1 |
| 6,203,847 B1 | * | 3/2001 | Conner et al. | 29/889.1 |

FOREIGN PATENT DOCUMENTS

| | | |
|---|---|---|
| DE | 4411680 C1 | 8/1995 |
| EP | 0298309 A1 | 1/1989 |
| EP | 0386618 A1 | 9/1990 |
| EP | 0713957 A1 | 5/1996 |
| EP | 0813930 A2 | 12/1997 |
| EP | 0861919 A2 | 9/1998 |
| EP | 0934795 A2 | 8/1999 |
| EP | 1013786 A1 | 6/2000 |
| JP | 04032546 | 2/1992 |

OTHER PUBLICATIONS

"Chemical Vapor Deposition and Related Processes", Surface Engineering, pp. 1166–1170 (no date).

* cited by examiner

*Primary Examiner*—Bret Chen
*Assistant Examiner*—Jennifer Kolb Michener
(74) *Attorney, Agent, or Firm*—Burns, Doane, Swecker & Mathis, L.L.P.

(57) ABSTRACT

The invention relates to a process of repairing a MCrAlY-coating of an article, which has being exposed to the hot gases of, for example, a gas turbine. The MCrAlY-coating is examined and repaired only locally where it is needed and then, subsequently, on top of the MCrAlY-coating the article is aluminized and/or chromized, avoiding the stripping of the whole coating and re-coating over the entire surface of the article. This is for replenishing the coating of Al and/or Cr that become depleted during engine operation, in an easy, cost and time saving manner.

13 Claims, No Drawings

PROCESS FOR REPAIRING A COATED COMPONENT

This application claims priority under 35 U.S.C. §§119 and/or 365 to Appln. No. 00112068.2 filed in Europe on Jun. 5, 2000; the entire content of which is hereby incorporated by reference.

FIELD OF INVENTION

The invention relates to a process of repairing a coated component according to the preamble of claim 1.

STATE OF THE ART

Most turbine components are coated for protection from oxidation and/or corrosion with, for example, a MCrAlY coating (base coat) and some are also coated with a thermal barrier coating (TBC) for thermal insulation. The demands of operation of the parts in a gas turbine often lead to the degradation of the coating before the structural integrity of the underlying part itself is degraded. Hence, the base coat and TBC must be removed and reapplied. Such processes are known from EP-A2-813 930, EP-A1-298 309 or U.S. Pat. No. 5,728,227

The coatings must be replaced because during service they degrade by forming protective aluminium and/or chromium oxides on the surface, which periodically spall off and must be replaced by fresh Al and/or Cr from the coating. Hence, Al and/or Cr diffuses from the interior of the coating towards the coating surface to continually replenish the protective oxides. It is known that the level of degradation of a coating (i.e. the remaining life) can be characterised by the amount of Al and/or Cr, left in the coating compared with the amount first present in the originally applied coating. It is also known that turbine blades and other components have only local areas of extremely high surface temperature during operation, whereas the rest of the component surface has a moderate temperature. This means that the environmentally protective coatings are degraded by far the most in these local areas of high temperature, which constitute about 5 to 20% of the total surface area of the whole component, and only moderately over the rest of the surface area. For older gas turbine engines where components operate at a low temperature, it is widely practised to locally replace the depleted coatings (MCrAlY) in the local hot areas, but leave the rest of the coating alone since it is not yet depleted in Al and/or Cr to the point that it cannot survive another inspection interval of the engine operation However, modern gas turbines operate at higher temperatures, where local hot spots on the blades completely deplete Al from the MCrAlY coatings, and partial depletion of Al from the coating over the rest of the blade is such that they usually can not survive another inspection interval. Therefore the entire coating must be stripped and replaced. The stripping of the coating involves a treatment with very aggressive acid which also removes some of the base material of the blade, may lead to weakening of the material at the surface, is expensive and time consuming. Re-coating of the blade is also expensive, and both operations have a certain scrap rate due to problems in the process.

SUMMARY OF THE INVENTION

It is an object of the present invention to find a method of restoring enough Al and/or Cr to the partially depleted MCrAlY-coating on the cooler parts of the turbine blades so that it could survive a complete inspection interval of engine operation, while only locally repairing the "hot spots" which are completely depleted and beyond such restoration due to the excessive coating spallation.

According to the invention a process was found of repairing an article with a MCrAlY-coating after use of the article in a high temperature environment where the MCrAlY-coating is repaired locally and the article is aluminised and/or chromised on the surface of the article on top of the MCrAlY-coating This method saves both time and investments costs because stripping and recoating using usual plasma spraying would be unnecessary. On the other hand is it possible to replenish the amount of Al and Cr in the depleted surface of the article in an easy way.

The areas requiring local repair of the MCrAlY coating are by definition subject to the highest levels of depletion of Al and/or Cr. Associated with this depletion will be a significant thickness of depleted (non-functioning) MCrAlY coating and also of oxide scale. If the repair MCrAlY coating material is to properly bond to the substrate, all of the oxide scale must be removed, as much of the depleted coating as possible, without affecting the base material under the coating unless this also has been oxidized. Therefore, it is highly advantageous to prepare the areas requiring local MCrAlY repair by cleaning using any conventional means such as local chemical etching, grit blasting, grinding or other abrasive methods. This will ensure a long lasting bond of the newly applied coating material to the substrate.

Another advantage comes from the fact that the method is also applicable even when a ceramic coating is existent. The ceramic coating, which is on top of the MCrAlY-coating, can be removed with any possible means before applying the steps of the method of the invention and the article is re-coated with a ceramic coating thereafter.

In another embodiment the aluminising and/or chromising takes place before the local repair of MCrAlY which is still possible to fulfil the same desired effect.

A further advantage would be that the problem of plugging the cooling holes with sprayed coating would be avoided. Since cooling holes offer local protection from high temperatures, the coating would not require local replacement close to the cooling holes. Thus, the coating could be locally replaced in the hot areas and then the entire blade aluminised without plugging the cooling holes with sprayed coatings. In any case it is possible to mask the cooling holes during the local coating repair or aluminising method according to the invention to avoid a reduction of the size of the cooling holes during the proposed method.

Of course, an article comprising an inner and an outer surface with a MCrAlY-coating will be aluminised and/or chromised at the said inner and at the said outer surface.

The enrichment with Al and/or Cr within the MCrAlY-coating is optimised when the aluminising and/or chromising is followed by a diffusion heat treatment. Alternatively a "high activity" aluminising can be used so that Al is deposited not only at a surface layer of the MCrAlY-coating, but diffuses into the MCrAlY-coating. Preferably the aluminising takes place with a gas phase method.

In another advantageous embodiment, the local repair of the MCrAlY-coating takes place with a corrosion resistant coating containing a high amount of Cr. With that embodiment the corrosion resistance is enhanced at those areas most vulnerable thereby increasing the overall life time of article.

An article as it is claimed can possibly be a blade or a vane or any other part of a gas turbine engine coated with a MCrAlY-coating and exposed to a high temperature. environment.

DETAILED DESCRIPTION OF INVENTION

The invention is related to a process of repairing an article with a MCrAlY-coating being exposed to a high temperature environment. The article could possibly be a blade or a vane or any other part of a gas turbine engine such as a part of a burner chamber exposed to the hot gases of the gas turbine, the article being coated with a MCrAlY-coating to protect it against oxidation. The MCrAlY-coating derives its protective capabilities as a result of the formation of a thin uniform layer of alumina on the surface of the coating. The alumina film forms as a result of the oxidation of aluminium in the coating. With the continued exposure to oxidising conditions at elevated temperatures the alumina layer continues to grow in thickness and eventually spalls off. The spallation is accentuated by thermal cycling. The alumina layer reforms after spallation provided that sufficient aluminum remains deeper down in the coating. This results in an Al and/or Cr depleted coating with no more oxidation resistance.

The method of the invention consists of the steps of repairing the MCrAlY-coating of the article during inspection locally where it is needed and subsequently aluminising and/or chromising the article on the surface of the article on top of the MCrAlY-coating. For determination where the MCrAlY-coating has to be repaired locally, any inspection method can be used.

The areas requiring local repair of the MCrAlY coating are by definition subject to the highest levels of depletion of Al and/or Cr. Associated with this depletion will be a significant thickness of depleted (non-functioning) MCrAlY coating and also of oxide scale. If the repair MCrAlY coating material is to properly bond to the substrate, all of the oxide scale must be removed, as as much of the depleted coating as possible, without affecting the base material under the coating unless this also has been oxidized. Therefore, it is highly advantageous to prepare the areas requiring local MCrAlY repair by cleaning using any conventional means such as local chemical etching, grit blasting, grinding or other abrasive methods. This will ensure a long lasting bond of the newly applied coating material to the substrate.

The method according to the present invention saves both time and investments costs because stripping and re-coating using conventional plasma spraying is unnecessary. On the other hand is it possible to replenish the amount of Al and Cr in the depleted surface of the article in an easy way, providing at the same time a possible way of prolonging the life time of the article.

MCrAlY protective overlay coatings are widely known in the prior art. They are a family of high temperature coatings, wherein M is selected from one or a combination of iron, nickel and cobalt. As an example, U.S. Pat. No. 3,528,861 or U.S. Pat. No. 4,585,418 disclose such oxidation resistant coatings. U.S. Pat. No. 4,152,223 as well discloses such method of coating and the coating itself.

The method of aluminising and chromising is described in e.g. Metals Handbook, Desk Edition (2. Edition), p. 1166–1170, issued by the American Society of Metals (ASM). Possible ways of deposition is known in the state of the art as chemical or physical vapour deposition (CVD, PVD). Preferable the aluminising takes place with a gas phase method.

An advantage is that the problem of plugging the cooling holes with sprayed coating is avoided. Since cooling holes offer local protection from high temperatures, the coating would not require local replacement close to the cooling holes. Thus, the coating could be locally replaced in the hot areas and then the entire blade aluminised and/or chromised without plugging the cooling holes with sprayed coatings. In any case, it is possible to mask the cooling holes during the method according to the invention to avoid a reduction of the size cooling holes during application.

In an advantageous embodiment, the local repair of the MCrAlY-coating takes place with a corrosion resistant coating containing high amount of Cr. This could as an example be an alloy known as Ni-25Cr-4Al—Si-TA-Y-coating, or just pure Cr. With that embodiment the oxidation resistance of the coating is maintained at the same time the corrosion resistant is achieved at areas highly needed due to the "hot spot" location, i.e. at points where it is exactly required. Thereby again increasing the overall life time of the article.

The enrichment with Al and/or Cr within the MCrAlY-coating is even better accomplished when the aluminising and/or chromising is supported by a diffusion heat treatment. A heat treatment which can achieve the intended result is e.g. 2–4 hours in a vacuum furnace or in an inert or reducing gas atmosphere a temperature of 1080 degree C. or 1140 degree C. This effect is also or in addition possible by using an "high activity" aluminising so that it takes place not only at a superficial layer of nearly pure Al and/or Cr on the outer surface of the MCrAlY-coating, which would quickly melt or oxidise away during service, but the Al diffuses into the MCrAlY-coating.

The method is also applicable even when a ceramic coating exists. The ceramic coating (thermal barrier coating known as TBC), which is on top of the MCrAlY-coating, can be removed with any possible means (e.g. acid cleaning) before applying the steps of the method of the invention and the article is re-coated with a TBC thereafter.

In another embodiment the aluminising and/or chromising takes place before the local repair of MCrAlY which is still possible to fulfil the same desired effect of replenishing the depleted coating.

Of course, when the article comprises an outer and an inner surface such as an internal cooling system, the MCrAlY-coating of the article will repaired on the outside and aluminising and/or chromising may be done on the inner surface as well as the outer surface.

What is claimed is:

1. Process of repairing a damaged, degraded, or consumed MCrAlY-coating of an article after use of the article at a temperature sufficient to partially deplete Al or Cr from the MCrAlY-coating, the process comprising:

repairing the MCrAlY-coating locally by replacement with new MCrAlY; and aluminising or chromising the partially depleted MCrAlY-coating on the surface of the entire article so that Al or Cr is at least partially diffused into the partially depleted MCrAlY-coating to replenish an amount of Al or Cr in the partially depleted MCrAlY-coating, wherein the step of aluminising or chromising occurs before or after repairing the MCrAlY-coating locally.

2. Process of claim 1, comprising preparing an area for local repair by cleaning by an abrasive mechanical means or chemical means, wherein residual damaged or consumed MCrAlY-coating is removed.

3. Process of claim 1, wherein a ceramic coating, which is on top of the MCrAlY-coating, is removed before applying the steps of the method and the article is recoated with a ceramic coating thereafter.

4. Process of claim 1, wherein the article has an inner and an outer surface and it is aluminised and/or chromised at the inner and at the outer surface.

5. Process of claim 1, wherein the article has a plurality of cooling holes, the cooling holes masked during the method.

6. Process of claim 1, wherein after the aluminising and/or chromising there is a diffusion heat treatment.

7. Process of claim 1 wherein the new MCrAlY for local repair of the MCrAlY coating contains at least 25 wt. % Cr.

8. Process of claim 1, wherein the article is aluminised using a method which introduces Al to the surface via a gas phase.

9. Process of claim 1, wherein the article is a blade or a vane or any other part of a gas turbine engine exposed to a high temperature environment coated with a MCrAlY-coating.

10. Process of claim 1, comprising both aluminising and chromising.

11. Process of claim 2, wherein abrasive mechanical means includes grinding or grit blasting.

12. Process of claim 2, wherein chemical means includes chemical etching.

13. Process of claim 1, wherein the article is aluminised using a method of aluminising to form a superficial layer of nearly pure aluminum on the surface of the MCrAlY-coating and to diffuse Al into the MCrAlY-coating.

* * * * *

UNITED STATES PATENT AND TRADEMARK OFFICE

CERTIFICATE OF CORRECTION

PATENT NO. : 6,569,492 B2
DATED : May 27, 2003
INVENTOR(S) : John Fernihough et al.

It is certified that error appears in the above-identified patent and that said Letters Patent is hereby corrected as shown below:

Title page,
Item [73], should read
-- ALSTOM Switzerland Ltd., Baden, Switzerland --

Signed and Sealed this

Sixteenth Day of December, 2003

JAMES E. ROGAN
*Director of the United States Patent and Trademark Office*